United States Patent [19]

Iwasaki et al.

[11] 4,035,544

[45] July 12, 1977

[54] ASPHALT ROOFING AND METHOD OF MAKING SAME

[75] Inventors: Hajime Iwasaki; Yasuo Tomita, both of Tokyo, Japan

[73] Assignee: Mitsuboshi Sangyo Kabushiki Kaisha, Tokyo, Japan

[21] Appl. No.: 612,565

[22] Filed: Sept. 11, 1975

[30] Foreign Application Priority Data

Sept. 12, 1974 Japan ..... 49-104327

[51] Int. Cl.[2] ..... B32B 11/02

[52] U.S. Cl. ..... 428/291; 427/434 R; 427/442; 427/443; 428/301; 428/489

[58] Field of Search ..... 427/434 R, 442, 443; 428/288, 291, 301, 489, 300

[56] References Cited

U.S. PATENT DOCUMENTS

| | | | |
|---|---|---|---|
| 1,347,095 | 7/1920 | Harrison | 427/443 |
| 1,587,652 | 6/1926 | Johnston | 427/442 |
| 1,809,360 | 6/1931 | Schutte | 427/443 |
| 2,012,968 | 9/1935 | Miller | 427/443 |
| 2,343,600 | 3/1944 | Weimann | 427/443 |
| 3,721,578 | 3/1973 | Bennett et al. | 428/291 |

*Primary Examiner*—James J. Bell

*Attorney, Agent, or Firm*—Wenderoth, Lind & Ponack

[57] ABSTRACT

An asphalt roofing which comprises a base material of a bulky non-woven fabric made of filaments of synthetic fibres intertwined with each other and an asphalt with which said base material is uniformly and completely saturated and which also covers both sides of said base material. The non-woven fabric has a substantial thickness, such as 4–5mm, and is produced by the well-known needle-punching process. This base material is saturated with and covered by the single kind of asphalt. A method of making same comprises feeding said non-woven fabric along a vertical path into a bath of molten asphalt, thereby permitting the air contained within the fabric to successively escape vertically through the fabric itself into the atmosphere while permitting the fabric to be uniformly and completely saturated with said molten asphalt, and then withdrawing said fabric from the molten asphalt into the atmosphere and drying the same.

5 Claims, No Drawings

ASPHALT ROOFING AND METHOD OF MAKING SAME

FIELD OF THE INVENTION

The present invention relates to an asphalt roofing and a method of making same, and particularly it is directed to an asphalt roofing having an unitary construction including a base material of a bulky non-woven fabric made of long filaments of synthetic fibres and an asphalt with which said base material is uniformly and completely saturated and which also covers both side surfaces of said bulky non-woven fabric.

BACKGROUND OF THE INVENTION

A waterproof structure which is made by melting and spreading a natural asphalt over a substructure to continuously form a membrane thereby forming a water-tight layer on the substructure has been used for a long time in Europe. Such a waterproof structure, which is formed of a simple asphalt, cannot accept shrinking, cracking or repetition of such movement caused in the substructure, resulting in breakage of the waterproof structure, and also this structure is defective in its weather-resistant property, that is, it tends to crack or melt when it is subjected to violent changes of temperature. In order to eliminate such disadvantages, an improved waterproof structure has been invented which comprises a sheet-like reinforcement or base material embedded therein.

The reinforced asphalt structure of this kind is made by firstly preparing a felt-like base material of paper fibres, then saturating said base material with molten straight-run asphalt to form a so-called "asphalt-felt" and coating said asphalt-felt by blowing asphalt on both side surfaces of complete an asphalt roofing.

This structure has been further improved by using a base material made of cotton or linen fibres, which improve the strength of the base material, or are made of asbesto fibres, which improve the decomposition-resistant property thereof. This base material is saturated with straight-run asphalt and is coated with blown asphalt, in the same manner as in the asphalt-felt type structure, so that a three-layered structure having a core of the base material is formed.

Any of the felt-like base materials heretofore used has a water-absorbing property and is fabricated in a porous form, so that the waterproof structure making use of such felt-like base material has a defect in its waterproofing property because of the pinholes remaining in the base material layer and/or coating layer. The base material of this kind has further defects in that it is easily broken by shrinking or cracking of the substructure, trembling of a building standing thereon or repeated shearing stress, and any material other than asbesto has a tendency to decomposition.

In order to avoid the above defects, it is naturally conceived to use a base material made of synthetic fibres with several advantages, particularly in the form of a non-woven fabric. The non-woven fabric, if made of staple fibres, presents disadvantages similar to those of the above-mentioned felt-like structure and consequently it has little availability in the asphalt roofing structure. It has been proposed to develop a non-woven fabric of continuous filaments, but such a fabric has not yet been actually employed to make an asphalt roofing.

The non-woven fabric of continuous long filaments can be manufactured by an "adhering" method which comprises properly arranging the filaments of synthetic fibres extruded from a nozzle under the action of mechanical means or flowing air to form a web of randomly stratified synthetic fibres, then applying an adhesive material thereon by spraying or dipping, squeezing out an excess amount of the adhesive material from said web by means of rolls and then drying the same. Alternatively, the non-woven fabric of this kind can be manufactured by a "heat-pressing" method which comprises preparing a web as in the above adhering method and then pressing said web from one or both sides thereof by heating rolls having plain surfaces or heating rolls having a plurality of projections on the surfaces, thereby fusion-bonding the filaments.

In case of the non-woven fabric of adhering type, the fibres are so arranged that they are not directed to only one direction, thereby forming a web in which the fibres are stratified and adhered together at the crossing points thereof. In such a construction of the web, the evaporation of water occurs from the front and rear outside surfaces during the drying step, and the water remaining within the inside of the web is displaced successively under the capillary action toward the front and rear surfaces which contact the atmosphere. When the water is displaced, the adhesive material in or near the front surface is collectively carried by the water to the outside surface. Also the adhesive material in or near the rear surface is subjected to the same action, together with the action of gravity, whereby it is carried to the outside surface. Accordingly, the non-woven fabric thus obtained contains more amount of adhesive material in its front and rear surface regions than in its inside region, and its has been reported that the amount of the adhesive material contained in the surface region is about three times as much as that contained within the inside region of the fabric, resulting in an extremely unbalanced construction.

Now, the adhering structure of fibres constituting the non-woven fabric of this type will be considered. It has been reported that the non-woven fabric generally comprises adhered portions at the ratio of the 29% in which each of pairs of fibres are crossed and adhered together at substantially right angles, 25% in which each pair of fibres are adhered together at their outside surfaces and 46% in which three or more fibres are not crossed at a same point but adhered together at very close points. In case where the adhesive material is used in an amount of more than 6% of that of the fibres, the adhesive material forms films near the crossing points of the fibres, and it has been reported that in an example where the adhesive material has been used in an amount of 28% (by weight) of the fabric the adhesive material in the form of films might occupy about 50% of total surface area of the fibres.

Accordingly, the non-woven fabric of the adhering type is rigid and lacks flexibility, and the asphalt roofing using such non-woven fabric as its base material still presents disadvantages in that it tends to cause a crack when it is folded and it may bring about separations of the adhered portions when it is crumpled so that pinholes or interlayer separations are likely to be produced in the asphalt by the crack or some movement caused in the substructure, and in some cases the asphalt roofing may present substantially the same phenomenon as that of the oldest type base material made of paper felt.

When non-woven fabric of the heat-pressing type is used, the fibres are thermally bonded at their crossing points by the action of the heating rolls from the front side or front and rear sides, or the fibres are spot-bonded together by the action of the projections of the heating rolls. In any case, the fibres must be bonded together by the fusion-bonding action together with the pressing action, so that the non-woven fabric thus formed has a relatively increased fibre density and a rigid paper-like structure.

Thus, although the asphalt roofing making use of this type of non-woven fabric may present a somewhat improved character over that of adhering type in its tendency to crack when folded or with respect to inter-layer separation by crumpling, it presents another problem in that the rate of saturation of the fabric with asphalt is decreased because of the increase in the fibre density, so that the fabric must be treated at higher temperatures in order to increase the rate of saturation. Moreover, the asphalt roofing of this type still presents the disadvantage of pinholes being produced in the asphalt by any crack in or some movement of the sub-structure.

The asphalt roofing making use of either type of the above mentioned non-woven fabrics presents another problem as explained hereunder. The asphalt roofing is manufactured, in the same manner as the paper fibre roofing as aforementioned, by the method comprising two steps of saturating the non-woven fabric with molten asphalt (blowing asphalt having good quality) and then coating the saturated fabric with the same asphalt on its both surfaces. When a waterproof layer is produced by such asphalt roofing, it is necessary to use a molten asphalt at high temperature, for example 240°–250° C, to adhere the asphalt roofing onto a sub-structure or the asphalt roofing layers one on the other. Since the asphalt roofing of the above type has a relatively small thickness (about 2 mm, including asphalt coating layers on front and rear surfaces), it is wholly softened when it is exposed to such a high temperature, so that it tends to cause wrinkles or folds after cooling. Accordingly, the operation of applying the asphalt roofing requires a skilled worker.

As explained above, the non-woven fabric serves to increase the strength and decomposition-resistant property of the base material of the asphalt roofing but it still presents some disadvantages, and consequently there remains a question of why such a hard paper-like substance must be used as a base material of an asphalt roofing. In other words, the non-woven fabric including loosely interconnected fibres causes deformation of the fabric itself by the contraction or elongation of the fibres when it is exposed to a molten asphalt at high temperature and also it causes deformation by the action of the various rolls required for continuous production line.

It may be conceived to prevent such deformations by increasing the amount of the adhesive material, adding a heat-resistant adhesive material (for example, starch which is a natural, highly-polymerized substance) or compressing the fabric so as to increase the interconnection between fibres, but such measures of preventing the deformation of the fabric may necessarily result in losing the flexibility thereof and producing a more hardened paper-like structure. That is, such a concept is contrary to our invention which aims at providing a suitable base material for an asphalt roofing and a method of making the same without producing deformation of the fabric, in view of the fact that such a concept is primarily directed to the prevention of deformation of non-woven fabric even though as asphalt roofing can be produced therefrom.

Such a hardened non-woven fabric is effective in preventing the deformation, contraction or elongation, which may be caused when it is dipped in a hot molten asphalt, but this fabric cannot accept such severe situations as cracks in or some movement of the substructure, as explained above, in the process for preparing an asphalt waterproof layer in which the watertightness should be obtained by the non-permeability of the asphalt itself, therefore this type of non-woven fabric cannot be considered to provide a good asphalt roofing. For these reasons, an asphalt roofing having such non-woven fabric as its base material has not yet been widely used.

Recently another type of non-woven fabric has been developed. This non-woven fabric is manufactured by a "needle-punching" method which comprises developing long filaments of synthetic fibres, immediately after they have been melt-spun, into fore-and-aft and right-and-left horizontal directions to form a thick web in which the filaments are intertwined with each other, and then applying a needle-punching treatment thereto to cause the fibres to be oriented also in an up-and-down direction, thereby forming a non-woven fabric in which the fibres are oriented three-dimensionally and intertwined with each other in a complicated manner. The non-woven fabric of this type is entirely different from those of the above-mentioned two types, that is, the former is superior to the latter in tensile strength, compression-resistant property, restoring property or the like owing to the complicated and three-dimensionally intertwined structure of the many fibres and, in addition the former has a relatively large thickness and presents a bulky felt-like appearance.

This non-woven fabric has a further advantage in that a tensile force applied to stretch the fabric in right-and-left direction acts to cause the respective fibres in the fabric to come close together and increase the resistance against tensile stress, and further acts to rearrange the randomly arranged horizontal fibres into the stretching direction and draw out the fibres from the needle-punched region, whereby the fabric permits a considerably large elongation before it bcomes broken and easily restores its original shape after the tensile force is removed. Such a property cannot be obtained by the above two types of the non-woven fabrics, and this is superior character of the needle-punching type non-woven fabric.

This non-woven fabric is now widely used in the fields of heat insulation, cushions, filters, oil blotters, carpets and the like because of its flexible and bulky characteristics. However, it has been generally said that this type of non-woven fabric cannot be used as a material for fabricating asphalt roofing because this non-woven fabric contains fibres not adhered together and it is excessively flexible, stretchable and bulky, so that it becomes deformed when it is exposed to the molten asphalt at high temperature. This is a reason why an asphalt roofing having a base material of non-woven fabric of this type has not yet been actually put on the market throughout the world.

DESCRIPTION OF THE INVENTION

The characteristic features of the present invention reside in: adopting the non-woven fabric needle-punching type as a base material of an asphalt roofing; skillfuly substituting molten asphalt for the air contained within said base material; completely and uniformly saturating said base material with the molten asphalt, by a single step using a single kind of asphalt, that is, without requiring two steps and two kinds of asphalt, blowing asphalt and straight-run-asphalt, as in the conventional asphalt roofing; and providing a thick, flexible and bulky asphalt roofing which is superior in elongation and has a really integrated construction which appears as if a base material is sealed in an asphalt layer. Heretofore, an asphalt roofing has not been used in the form of a single sheet or single layer because this conventional asphalt roofing has a small thickness, and it has been necessary to apply a first roofing layer upon a substructure by using a molten asphalt layer therebetween to adhere them together, then applying a second roofing layer upon the first roofing layer by using a second molten asphalt layer therebetween and so on until a waterproof structure is obtained of the desired thickness. Such a procedure of applying a plurality of roofing layers requires skilled workers together with many assistant workers, because of the complicated operations being required for this procedure, in order to avoid the deformation of the asphalt roofing caused by the high temperature of the molten asphalt as mentioned above. The waterproof layer thus formed would appear as if it has a unitary construction, notwithstanding the fact that no solution has been made to the above-mentioned problems. In fact, however, this waterproof layer is of a laminated structure consisting of asphalt layers which play a primary role of forming waterproof layers and reinforcing the base material layers which serve as supporting layers for supporting said asphalt layers. These two kinds of layers, even if they cooperate with each other, are essentially different from each other in their objects, properties and constructions, and, also, their functions are not same. These differences frequently cause an incompleteness in the waterproofing function.

Accordingly it is an object of the present invention to provide an asphalt roofing for producing a complete, waterproof structure.

It is another object of the present invention to provide a method of making such asphalt roofing.

It is another object of the present invention to provide an asphalt roofing using a bulky non-woven fabric made of long filaments of synthetic fibres as its base material.

It is a further object of the present invention to provide a method of making such asphalt roofing in which the bulky non-woven fabric is uniformly and completely saturated with a single kind of asphalt.

In accordance with an aspect of the present invention there is provided an asphalt roofing comprising a bulky non-woven fabric made of filaments of synthetic fibres randomly intertwined each other, said base material having a substantial thickness, and an asphalt with which said base material is uniformly and completely saturated and which also covers both sides of said base material.

In accordance with another aspect of the present invention there is provided a method of making an asphalt roofing comprising preparing a bulky and thick non-woven fabric made of long filaments of synthetic fibres randomly intertwined with each other, feeding said non-woven fabric along a vertical path into a bath of molten asphalt, thereby permitting the air contained within the fabric to successively escape vertically through the fabric itself into the atmosphere while permitting the fabric to be completely saturated with the molten asphalt, and then withdrawing said fabric from the molten aspahlt into the atmosphere and drying the same.

The asphalt roofing according to the present invention has sufficient thickness to form a waterproof structure by a single layer so that it is not necessary to laminate a plurality of roofing layers. Moreover, this roofing is made in the form of a unitary structure in which a base material of non-woven fabric is sealed in an asphalt layer and which serves as a complete watertight structure, and consequently it can form a satisfactory waterproof structure by a single roofing layer.

Now, the description will be given to comparing tests of the asphalt roofing according to the present invention with those which use base materials of non-woven fabrics of adhering and heat-pressing types (the latter being usually used in laminated form including two or more layers). Usually the tests of tensile strength and elongation are performed by Shopper type testing machine. According to the conventional tests, the relationships between tensile strength and elongation after breakage of a test piece can be measured, but the results concerning water-permeability owing to pinholes produced before breakage of a test piece cannot be obtained. Therefore, we have conducted a breakage test in a different way as explained hereunder.

In this test, we used a slate plate which has a V-groove cut in its rear surface at right angle to the direction of a tensile force to be applied. A test piece of the asphalt roofing was adhered upon the front surface of said slate plate by means of molten asphalt. The tensile force was applied to stretch the slate plate to produce a crack in the slate plate at the above-mentioned V-groove and then successively stretch the test-piece adhered thereon. The occurrence of pinholes in the test piece of asphalt roofing was observed by transmission of light issuing from a light source located below the slate plate. According to this method, tensile strength and elongation after breakage can be measured also.

It has been known that a crumpling effect on an asphalt roofing is produced by repeated expansion and contraction the in vertical or horizontal directions, of a crack generated in a substructure owing to variation of temperature, vibration or the like, and the crumbling effect has a considerable influence upon the waterproof layer. In order to reproduce this crumpling effect, we conducted a repeated shearing test.

In this test, we used a pair of horizontal plates, a vertically movable vibrating plate and a fixed plate, which are arranged so as to contact with each other at their edges. A test piece of the asphalt roofing was placed over both plates and fixed to the respective plates by means of mechanical supports at the points having a distance of 5mm the right and left, respectively, from the contacting edge. The crumpling effect was applied by vertically moving the vibrating plate by a distance of 10mm in one second.

After 2000 times of the vibration, as measured by an automatic counter, the shearing test piece was tested for water-permeability by applying water pressure of 10 kg/cm$^2$ for ten minutes. Then, the water-permeability tests were successively made after 2500 times, 3000 times and so forth, together with visual tests. In this connection, it is to be noted that in either of the breakage test and the shearing test, laminated structures each including two layers adhered together were used as the respective test pieces of the asphalt roofings including the base materials of the adhering and heat-pressing type non-woven fabrics, while a single layer having 4mm thickness was used as the test piece of the asphalt roofing according to the present invention.

The test results and the testing processes will be explained hereunder. Table 1 shows the results of the comparing test.

Table 1

| | "A" "Heat-pressing" (2-layers) | "B" "Adhering" (2-layers) | "C" Invention (1-layer |
|---|---|---|---|
| Thickness (mm) | 5.5 | 6.0 | 5.5 |
| Weight (Kg/mm²) | 6.0 | 6.5 | 4.5 |
| Stretching test (25° C) | | | |
| Tensile strength (Kg/cm²) | 20 | 30 | 62 |
| Elongation (%) | 33 | 14 | 80 |
| Breakage test (−3 ~ −5° C) | Pinhole occurred at 12 mm width | Broken at 13mm width | Nothing occurred at 30mm width |
| Repeated shearing test (−7 ~ −8° C) | 3,000 times | 3,600 times | 15,000 times |
| Water-permeability test after repeated shearing (Water pressure (10 Kg/cm²) | Permeable | Permeable | Not permeable |

In the above Table, the breakage test piece "A" produced transmission of light occurrence of pinholes when the width of the crack produced in the slate plate had reached 12mm, and then it was broken at the crack width of 15mm. The piece "B" produced pinholes and at the same time it was broken at the crack width of 13mm. The test piece "C" according to the present invention did not produce any pinholes even after it had reached to 30mm, the limit of the test machine, and it was not broken without causing any abnormal condition.

In the shearing tests, the water-permeability test was made under the above-described conditions, after 2000 times of repeated vertical movements applied to the test piece. No water-permeability was seen in any of the test pieces A, B and C. Then, the water-permeability tests were made after each additional 500 times of the repeated vertical movements. The test piece A indicated and water-permeability after 3000 times. Then, the tests were performed after each additional 200 times of the repeated vertical movements. The test pieces B and C did not indicate any water-permeability after 3400 times, and the test piece B produced water-permeability after 3600 times. Then the tests were continued on the test piece C only. However, no change was seen after 5,000 times and 10,000 times, and even after 15,000 times, and thus the test was terminated.

Compared with the conventional asphalt roofing having a sandwich construction including a core made of a base material saturated with straight-run asphalt and a pair of coatings of blown asphalt applied onto said core, the asphalt roofing according to the present invention is characterized by a completely unitary construction in the form of a single thick blown asphalt layer in which is sealed a bulky non-woven fabric made of continuous long filaments of synthetic fibres which are arranged in three-dimensional form and in fore-and-aft, right-and-left and up-and-down directions and intertwined with each other in a complicated manner. Thus the asphalt layer, which should function as a primary waterproofing structure, is directly assisted by the non-woven fabric which serves to provide the increased elongation and tensile strength, the increased resistance to breakage as well as the increased adaptability to the crumpling effect.

Furthermore, as compared with the conventional asphalt roofing which must be used in a laminated form including at least two or three layers, the asphalt roofing according to the present invention can be employed in the form of a single layer, so that the weight per unit area is substantially decreased, and yet it is not inferior in its technical advantages and forms a truly integrated layer of waterproof structure, which can completely eliminate the disadvantages owing to the differentiation in function of the respective layers in the conventional laminated waterproof structure.

The asphalt roofing according to the present invention provides many advantages, directly or indirectly, not only in the field of waterproofing art but also in the field of construction as well as in the earth-working, traffic and agricultural fields. For example, it has advantageous effects in providing the decrease in weight of a flat roof for a building of combination structure type, particularly a skyscraper, the increase of working speed and working area owing to the omission of the laminating procedure and the consequent decrease of working period, the saving of materials such as fuel and adhesive material, and the unifying and simplifying of products and the consequent decrease of need for skilled workers and assistant workers.

The asphalt roofing according to the present invention can be advantageously used, in addition to the preparation of waterproofing structures for flat roofs, to the construction of open-air reservoirs, fishponds or flumes, road repairing, the preparation of roadbeds for rails or sound arresting walls or other various fields.

Next, the method according to the present invention will be explained. Heretofore, it has been a usual practice to manufacture an asphalt roofing by preparing a base material of a paper-like structure made of pulp, cotton, linen, asbestos or like material, dipping said base material into a bath of molten straight-run asphalt, and then coating the base material by blowing asphalt on both its sides, but the asphalt roofing thus manufactured has some defects as mentioned above. Another method for manufacturing an asphalt roofing employs a base material which is made of a non-woven fabric or staple fibres of synthetic fibres which improves the mechanical strength, decaying tendency, durability or the like of the base material made of the paper-like structure. The latter method comprises dipping the base material into a bath of molten blowing asphalt having good quality and then coating said base material with asphalt of same kind to constitute as asphalt roofing.

According to these conventional methods, the base material is saturated with asphalt by introducing the base material at a high speed along an inclined path from an upper position into a bath of molten asphalt having a high temperature such as about 200° C, then withdrawing said base material from within the molten asphalt into the atmosphere and then repeating such procedures for a few times. In such saturating process, the air in the base material, which is heated and inflated, escapes into the molten asphalt while the molten asphalt permeates into the base material. The fibres constituting the base material do not always form homogeneous spaces therein, and consequently the air coming out from the larger or smaller spaces forms various sizes of air bubbles in the molten asphalt. Some of the bubbles may combine with each other to form larger bubbles and some of them may form a group of bubbles, while the other may be divided into smaller bubbles. Some of these various sizes of the air bubbles may leave off the base material and rise to the surface, while the other may stick to the front or rear surface of the base material and move therewith. Under such circumstances, the leading portion of the base material when passing through the molten asphalt produces various types and large quantities of air bubbles in the molten asphalt, while the trailing portion of said base material containing cool air enters successively into the molten asphalt including these air bubbles. The result is that the generation of air bubbles is further increased while the time required for the bubbles to move to the surface is increased, inasmuch as the molten asphalt has a considerable viscosity even if it is maintained at high temperature to make it flowable.

Particularly in the conventional methods in which the base material is fed along an inclined path into the molten asphalt, all of the air bubbles issuing from the rear surface or inside surface of the base material tend to stick to the rear surface of the base material when they move to the surface, and these air bubbles once sticking to the surface of the base material are carried downward when the base material proceeds downward in the bath of molten asphalt, so that the air bubbles are further prevented from moving to the surface of the bath. Such a phenomenon is usually seen in the conventional process of making asphalt roofings and a considerable amount of the air bubbles is produced in this process. Consequently, it is very difficult to completely saturate the base material with the molten asphalt, particularly in the parts having high fibre density, so that some parts may not be completely saturated with asphalt.

In the case of the asphalt roofing employing the non-woven fabric made of synthetic fibres as its base material, the defects in the asphalt roofing using pulp, cotton, linen, asbestos or the like material are substantially eliminated, but the asphalt roofing of this type usually has a very small thickness, such as 1mm or less, compared with the non-woven fabric used in the present invention (made of polypropylne filaments, for example) which is bulky and has a thickness several times as large as the former. A bulky non-woven fabric has been also produced as hereinabove explained, but the conventional fabric of this kind tends to cause softening of the fibres, resulting in deformation, contraction or elongation when it is dipped in a molten asphalt having a high temperature of about 150° C. Also the non-woven fabric of this kind tends to produce considerable deformation owing to tension being applied thereto by feeding or receiving rolls during moving in a dipping tank.

If the lower temperature of the molten asphalt is used in order to avoid the deformation, the molten asphalt may only adhere onto the surface of the non-woven fabric and even if it can slightly pass into the non-woven fabric, it can never reach to the center of the fabric to completely saturate the same. This is the reason why the asphalt roofing employing the base material of the bulky non-woven fabric has not yet been put into actual use even though the bulky non-woven fabric of this kind had been well known.

In accordance with the method of the present invention, the bulky non-woven fabric of the polypropylene filaments made by the above-mentioned needle-punching method is introduced into a dipping tank in such a manner that it enters vertically into a bath of molten asphalt in the dipping tank in which a temperature gradient is maintained from a lower temperature at the surface to higher temperature at the bottom, whereby the non-woven fabric passes downward through the molten asphalt, while it is firstly subjected to the preheating and film forming process in the lower temperature zone near the surface, is secondly subjected to the bubble issuing ans asphalt saturating process in the medium temperature zone and lastly completes the saturating process in the highest temperature zone near the bottom. Then said non-woven fabric passes upward along an inclined path into the atmosphere, while it is successively subjected to the gradual cooling and film forming process. This saturating process provides a method for manufacturing an asphalt roofing which retains the width and the thickness of the base material and contains no void in the outside zone nor in the inside zone so that the molten asphalt completely takes the place of the air contained in the non-woven fabric.

In one example of the method for manufacturing the asphalt roofing according to the present invention, a dipping tank having a content of 5 tons is used. The molten blowing asphalt is fed from a separate heating and accumulating tank to the dipping tank through an inlet at the bottom thereof. while the molten asphalt is circulated from the surface region of the bath in the dipping tank to the heating tank. In the dipping tank, a receiving roll is disposed at the depth of about 70cm from the surface of the molten asphalt. The dipping tank is arranged to maintain the temperature of the molten asphalt bath at 150° C in the bottom zone near the receiving roll, 145° C in the intermediate zone at the depth about 40–50cm from the surface and 140° C in the surface zone.

A feeding roll is disposed above the surface of the molten asphalt bath. The bulky non-woven fabric made of polypropylene filaments is fed from said feeding roll toward the receiving roll, maintaining a vertical path of said fabric at right angle to the surface of the molten asphalt. The non-woven fabric entering into the molten asphalt firstly comes into contact with the molten asphalt maintained at 140° C, whereby the fabric becomes continuously coated with a film of the asphalt. The formation of this coating of asphalt film is due to the temperature of the molten asphalt at the contacting surface being slightly lowered by the contact with the cool air contained in the non-woven fabric. Such a phenomenon is in accord with the fact that when the conventional non-woven fabric is dipped into a bath of molten asphalt at relatively low temperature it becomes coated with an asphalt film on its surface which permits only slight impregnation, if any, of the fabric with the molten asphalt. The present invention has an originality in taking advantage of this phenomenon, as hereinafter explained.

In accordance with the present invention, the asphalt film formed on the surface of the non-woven fabric acts, together with the action of liquid pressure of the molten asphalt, to prevent the air contained in the non-woven fabric from escaping through the side surfaces of said fabric into the molten asphalt, with the result that the air in the non-woven fabric is moved upward through the non-woven fabric itself and is discharged into the atmosphere through the untreated portion of the fabric. The asphalt film further serves to prevent the softening of the polypropylene, while the non-woven fabric passes to the intermediate zone of the dipping tank maintained at 145° C. During the movement to the intermediate zone, the asphalt film previously formed is heated and fluidized, while the air remaining in the non-woven fabric continues to escape upward through the fabric itself and thus the fluidized asphalt film begins to easily enter into the inside of the non-woven fabric where the air has escaped upward.

Since the asphalt film thus formed is held by the fibres in the surfaces of the non-woven fabric, it never flows to another place, and as the non-woven fabric is introduced into the bath of the molten asphalt the asphalt film tends to successively move towards the center of the non-woven fabric under the action of the surrounding molten asphalt which successively increases its temperature and pressure. Thus the asphalt film in the non-woven fabric successively increases its thickness toward the center of said fabric, while the fabric is moved downward to the high temperature zone at the depth of about 70cm from the surface and is maintained at 150° C.

The asphalt film pasing into the non-woven fabric comes into contact with the fibres of the non-woven fabric and the air contained therein, whereby the asphalt film becomes slightly cooled, so that the asphalt film is always maintained at a slightly lower temperature than that of the molten asphalt at the same level and there is a slight temperature gradient in the fabric from the lower temperature at the center to the higher temperature at the outside of the fabric. Because of this slight temperature gradient, the tension caused in the non-woven fabric fed by the feeding and receiving rolls is relieved and the dynamic resistance applied during passing through the molten asphalt is decreased, thereby preventing the deformation, contraction or elongation, of the non-woven fabric.

When the non-woven fabric reaches the high temperature zone, at 150° C, of the molten asphalt, the asphalt films which have passed into the non-woven fabric from the both surfaces thereof come together until they become joined at the center of said fabric immediately before it reaches the receiving roll, thereby completely saturating the fabric with the asphalt. Immediately after passing around the receiving roll, the saturated non-woven fabric rises upward along an inclined path into the atmosphere, and then it is fed by another feeding roll disposed above the dipping tank and is subjected to an aftertreatment, whereby a bulky asphalt roofing is obtained.

In order to ascertain the complete saturation of the non-woven fabric with the asphalt, we took a sample of a portion of the non-woven fabric between the surface of the molten asphalt and the receiving roll. After removing the excess amount of the asphalt on the surfaces of said sample, we cut it along a longitudinal line. On the section of the cut sample, we observed that almost no asphalt passed into the non-woven fabric was seen, not only in the central part but also in the both surface parts (front and rear surface parts), in the area near the surface of the molten asphalt bath, so that the fabric is substantially in the original form, and the successively increased thickness of the asphalt was seen in each of the side surface parts toward the bottom of the molten asphalt bath, so that a V-shaped patter of the saturation of the fabric with the asphalt was seen on the section of the sample. The inside portion of said V-shaped patter consisted of unsaturated fibres and air, while the outside portion at each side thereof formed a successively increased thickness of the asphalt layer. At the point immediately before the apex of the V-shaped patter at the depth of about 70cm, the asphalt layers at both sides joined together to form a completely closed shape, that is, a completely saturated form.

It will be appreciated from the above that in accordance with the present invention the air and moisture contained in the non-woven fabric which have been heated and inflated under the action of the surrounding hot asphalt are carried upward through the structure of the unsaturated non-woven fabric with the fast movement of the upwardly flowing air to communicate into the atmosphere, and the fluidized asphalt films pass into the space within the fabric from which the air and moisture have moved away. Thus, the substitution of the asphalt for the air and moisture in the fabric structure can be performed in smooth manner, with the result that the fibres and the asphalt are homogeneously and strongly connected together without leaving any pinhole or void between the fibres unsaturated with the asphalt, after the non-woven fabric has completed the saturating process. Furthermore, in accordance with the present invention no air bubbles are produced in the molten asphalt, because the air passes upward and escapes into the atmosphere completely through the fabric structure itself, as explained above.

Upon the completion of the saturation of the non-woven fabric with the asphalt, the fabric is moved from the receiving roll upward along an inclined path in the molten asphalt bath in which the fabric is subjected to successively decreased temperatures. Accordingly, the non-woven fabric is gradually cooled. No violent change of flowing condition is produced owing to the temperature gradient maintained in the fibres and the asphalt held in the fabric, and the fabric is gradually relieved of pressure of the molten asphalt in the bath, so that the fabric restores its shape by the elasticity of the fibres. The fabric becomes coated on its surfaces with the molten asphalt which is maintained at a relatively low temperature near the surface of the bath, whereby good dimensional stability is obtained.

The asphalt roofing thus obtained from the base material of the bulky non-woven fabric is fed by a feeding roll disposed above the dipping tank and the excess amount of the asphalt is removed by means of a scraper or the like so as to hold a thickness which is somewhat larger than the original thickness of the non-woven fabric. This asphalt roofing is cooled and wound up to produce a completed roll of the asphalt roofing.

For reference, we conducted an experiment in which this non-woven fabric was introduced into the molten asphalt bath in the dipping tank along as inclined path in the same manner as in the conventional manner. In this experiment, the non-woven fabric was bent upward at the portion between the feeding and receiving rolls under the influence of buoyancy, and the asphalt film formed on the surface of the fabric as described above was broken under the action of the high pressure produced in the fabric structure owing to the air being heated and inflated therein at the regions having relatively low fibre density, so that the air was ejected into the molten asphalt. As the result, the ejected air produced many bubbles in the molten asphalt bath near the surface thereof, while the molten asphalt permeated into the low fibre-density regions of the fabric. On the other hand, the relatively high fibre-density region was surrounded by the preceding and succeeding low fibre-density regions and thus the air contained therein was disconnected from the air in the upper portion of the fabric. Consequently, the fabric was not completely saturated with the molten asphalt in the high fibre-density regions even after said fabric was fed to the bottom of the molten asphalt bath, thereby leaving some voids unsaturated with the asphalt. There were produced many air bubbles sticking to the inside or rear side of the fabric, and more air bubbles were produced than in the case of the above-mentioned thin non-woven fabric, resulting in an asphalt roofing which was not uniformly saturated with asphalt and included many deformations.

The present invention has many characteristic features, not only in the manufacture of an asphalt roofing employing a base material made of bulky non-woven fabric, but also in an equipment for manufacturing such asphalt roofing. In connection with the manufacturing equipment, the present invention provides many advantageous effects, such as, the considerable simplification of the dipping equipment (excluding the melting tank), for example to the extent of 1/20 of the conventional equipment, the elimination of noises to be produced by the continuous operation of many rolls, the increase of the dipping speed, the easy operation of the continuous treatment and the consequent reduction of the manufacturing processes, the savings of material, heat source and power consumption, the reduction of labour, as well as the uniformity and superiority of the products.

The method according to the present invention will be further explained with reference to the following examples.

EXAMPLE 1

The saturating process was carried out by employing a non-woven fabric of polypropylene filaments made by the needle-punching method (8 denier, 400g/m$^2$, thickness 4.0–4.2mm, needle-punchings 120/cm$^2$) and a catalytic air blowing asphalt (softening point 95° C, penetration 40 at 25° C, elongation 2.0 at 0° C).

The molten asphalt was supplied from the heating and accumulating tank to the asphalt dipping tank having a capacity of 5 tons through the bottom thereof, to maintain the temperatures of 150° C in the bottom region near the receiving roll disposed at the depth of 70cm in the tank, 145° C in the intermediate region at the middle of the receiving roll and the surface of the bath, and 140° C in the surface region. The molten asphalt was circulated from the surface region to the heating and accumulating tank to maintain a constant level of the molten asphalt bath in the tank.

The non-woven fabric was fed from the feeding roll disposed above the molten asphalt level to the receiving roll, along a vertical path at a right angle to the surface of the molten asphalt. A fabric was fed at the speed of 3m/min in the molten asphalt bath. As the fabric was fed into the asphalt bath, a slow convection was generated on the surface of the molten asphalt toward the front and rear surfaces of the fabric, and the asphalt films were formed on the fabric surfaces while they were moved toward the bottom of the bath.

When the non-woven fabric, while being saturated with the molten asphalt, reached to the depth of 70cm at 150° C, it was passed around the receiving roll and immediately carried upward along an inclined path in the bath. Then, the non-woven fabric was passed through a slit of 4mm between a pair of rolls which form a scraper disposed above the level of the molten asphalt bath, in order to continuously remove the excess amount of asphalt on the front and rear surfaces of the fabric to maintain a predetermined thickness of the fabric and finish smooth surfaces of said fabric. The fabric was then subjected to the cooling and winding up operations. Thus, a long asphalt roofing consisting of a bulky non-woven fabric completely saturated with and sealed in an asphalt layer, having a thickness of 4mm and a weight of 4Kg/m$^2$ was obtained.

In the process of continuous production of the asphalt roofing, no generation of air bubbles was seen on the surface of the molten asphalt, and no pinholes of voids were observed in the structure of the completed asphalt roofing, as proved by sampling tests. Thus, it was ascertained that in accordance with the method in the present invention an asphalt roofing having a base material of a bulky non-woven fabric made of polypropylene filaments was completely saturated with an asphalt.

EXAMPLE 2

The saturating process was carried out in the dipping tank as used in Example 1, under the same condition of temperature gradient, with the receiving roll disposed at the depth of 80cm, to saturate a needle-punching type non-woven fabric (15 denier, 450g/m$^2$, thickness 4.5–4.7mm, needle-punchings 120/cm$^2$) with a rubberized asphalt (softening point 100° C, penetration 35 at 25° C, elongation 2.2 at 0° C) at the speed of 4m/min.

In Example 2, the thickness of the fibre in the non-woven fabric was twice as large as that of Example 1, so that the amount of the fibres contained in a unit volume of the non-woven fabric was substantialy decreased in comparison with Example 1, resulting in the decrease of intertwining of fibres and, consequently, the increase of tendency of producing elongation or deformation of the fabric by the stretching force applied by the feeding and receiving rolls. In order to prevent such tendency of producing elongation of deformation, the time of the non-woven fabric staying in the molten asphalt was decreased.

Furthermore, in Example 2, the fibre in the non-woven fabric had an increased thickness, as mentioned above, and consequently an increased resistance to the molten asphalt. Accordingly, in order to promote the saturation of the fabric with a rubberized asphalt which has higher viscosity than that of the molten asphalt as used in Example 1, the liquid pressure was increased by lowering the position of the receiving roll, that is, increasing the depth of said receiving roll, and the non-woven fabric was fed at faster speed, whereby the treating length or the treating area of the non-woven fabric in the molten asphalt bath was increased, while the fabric was moved to the bottom of the bath at faster speed, as compared with Example 1.

The fabric was subjected to the same after-treatment as in Example 1, to produce a rubberized asphalt having a base material of a bulky non-woven fabric made of synthetic fibres. Thus, a product having a large length and thickness such as 4.5mm was obtained. Such a long and thick product of asphalt roofing has not yet been manufactured in the past throughout the world.

We claim:

1. In a method of producing an asphalt roofing including:

preparing a bulky non-woven fabric having substantial thickness made of filaments of synthetic fibers randomly intertwined with each other, and continuously feeding said non-woven fabric through a bath of molten asphalt, whereby said fabric is progressively saturated with asphalt while it is continuously moving through said molten asphalt, the improvements comprising:

maintaining a temperature gradient in said bath of molten asphalt with a lower temperature near the surface to a higher temperature at the bottom thereof; and feeding said non-woven fabric downward along a vertical path to the bottom of said bath and then upward along an inclined path toward the atmosphere, whereby said non-woven fabric moving through said molten asphalt bath is first preheated and an asphalt film formed on both surfaces thereof as it first enters said bath; said films are progressively fluidized and the air contained in said fabric is gradually moved upward within said fabric itself as said fabric moves vertically downward through said asphalt bath; said asphalt films, successively fluidized as said fabric moves through said bath, progressively penetrate into said fabric from which the air has moved upward until said asphalt completely penetrates to the center of said fabric; and finally, said completely asphalt-penetrated fabric is gradually cooled and formed with asphalt films on both surfaces thereof as it comes out of said bath into the atmosphere, thereby forming a bulky asphalt roofing completely saturated with asphalt.

2. An improvement as claimed in claim 1 wherein said non-woven fabric is comprised of filaments of polypropylene fibers.

3. An improvement as claimed in claim 1 wherein said temperature gradient is maintained at a lower temperature of 140° C near the surface to a higher temperature of approximately 150° C near the bottom of said bath.

4. An improvement as claimed in claim 1 wherein said non-woven fabric has a thickness of 4mm.

5. An asphalt roofing comprising:

a base material fabric of bulky, non-woven synthetic fibers intertwined with each other; and asphalt uniformly and completely saturated into and completely covering both sides of said fabric, said asphalt being applied according to the process of claim 1.

* * * * *